United States Patent [19]

Huffstutler

[11] Patent Number: 4,716,977

[45] Date of Patent: Jan. 5, 1988

[54] SPECIALLY SHAPED CUTTING ELEMENT FOR EARTH BORING APPARATUS

[75] Inventor: Alan D. Huffstutler, Grand Prairie, Tex.

[73] Assignee: Dresser Industries, Inc., Dallas, Tex.

[21] Appl. No.: 944,773

[22] Filed: Dec. 22, 1986

Related U.S. Application Data

[63] Continuation-in-part of Ser. No. 857,701, Apr. 29, 1986, abandoned.

[51] Int. Cl.[4] ..... E21B 10/16; E21B 10/52

[52] U.S. Cl. ..... 175/410

[58] Field of Search ..... 175/374, 410, 331

[56] References Cited

U.S. PATENT DOCUMENTS

| | | | |
|---|---|---|---|
| 2,121,202 | 6/1938 | Killgore | 255/71 |
| 2,774,570 | 12/1956 | Cunningham | 255/347 |
| 3,239,431 | 3/1966 | Knapp | 175/331 |
| 3,388,757 | 6/1968 | Fittinger | 175/410 |
| 3,442,342 | 5/1969 | McElya et al. | 175/374 |
| 3,495,668 | 2/1970 | Schumacher, Jr. | 175/341 |
| 3,743,038 | 7/1973 | Bennett | 175/341 |
| 4,058,177 | 11/1977 | Langford et al. | 175/374 |
| 4,086,973 | 5/1978 | Keller et al. | 175/374 |
| 4,108,260 | 8/1978 | Bozarth | 175/374 |
| 4,168,923 | 9/1979 | Vezirian | 403/267 |

FOREIGN PATENT DOCUMENTS

| | | | |
|---|---|---|---|
| 2031047 | 4/1980 | United Kingdom | 175/410 |
| 244980 | 10/1969 | U.S.S.R. | 175/374 |
| 316835 | 12/1971 | U.S.S.R. | 175/410 |
| 456885 | 2/1975 | U.S.S.R. | 175/374 |
| 474594 | 9/1975 | U.S.S.R. | 175/374 |
| 1146397 | 3/1985 | U.S.S.R. | 175/374 |

*Primary Examiner*—James A. Leppink
*Assistant Examiner*—Hoang C. Dang

[57] ABSTRACT

A cutter element for a rotary type rock bit used in drilling soft earth formations in which the cutter element includes a base and a generally dual pyramidic cutting tip. The cutting tip extends from the base to a crest and is formed having axially symmetrical opposite flanks that extend longitudinally merging toward a distal end at which a single elongated crest of substantially uniform width is formed about an apex.

12 Claims, 11 Drawing Figures

SPECIALLY SHAPED CUTTING ELEMENT FOR EARTH BORING APPARATUS

This application is a continuation-in-part of application Ser. No. 857,701 filed Apr. 29, 1986 now abandoned.

TECHNICAL FIELD

The technical field to which the invention pertains includes the field of earth boring equipment and more specifically to a cutter tooth element on a rolling cutter bit.

BACKGROUND OF PRIOR ART

Since the advent of the rolling cutter rock bit for earth boring, a large number of different tooth shapes have evolved for improving rate of penetration and life expectancy in the variety of specific geological formations for which they were intended. Exemplifying insert type cutter teeth of the prior art are U.S. Pat. Nos. 3,442,342 and 4,086,973. Disclosed in those patents are specially shaped tungsten carbide inserts for rotary cutter rock bits with the '342 patent disclosing a specific shape suitable for drilling hard abrasive formations. The '973 patent discloses a shape more readily adapted for drilling formations of medium hardness, e.g., hard shales, dolomite and some limestones. Further disclosed in the '342 patent are two cutter inserts having tips representing a modified chisel with convex flanks converging to a crest while the '973 patent discloses a wedge shape insert in which the flanks are twisted or canted away from each other. Rounded intersections are provided to avoid sharp corners and sharp edges which can cause high stress concentration to be incurred.

More suitable for relatively soft or medium earth formations is the insert shape of U.S. Pat. No. 4,108,260. As therein disclosed, the insert is generally chisel shaped with asymmetrical flanks converging to a crest. The leading flank is scoop-shaped and the trailing flank is rounded outwardly.

In U.S. Pat. No. 2,774,570 there is disclosed an annular series of cylindrical inserts of hard wear-resistant material. The insert axes extend outwardly and substantially normal to the surface of the body and present protrusions at the surface to effect a disintegrating action while maintaining gage of the well bore being drilled. Numerous other shapes and configurations for various intended purposes are likewise known. See for example U.S. Pat. Nos. 2,121,202; 3,339,431; 3,495,668; 3,743,038; 3,388,757; 4,058,177; 4,108,260; and 4,168,923. It is of course important to bear in mind that the ultimate objective with respect to such cutters is to achieve a high rate of penetration into the particular earth formation for which the cutter design is intended. At the same time it is important to realize long term life expectancy from such bits whereby a maximum penetration depth is achieved in the shortest possible time before replacement of the cutter becomes necessary.

The cutting structures disclosed in the foregoing patents have various degrees of merit in achieving their sought after objectives, but none are specifically adapted for maximizing the rate of penetration and durability in relatively soft geological formations such as soft clays, sandy clay, sandstones or marl (those having low compressive strength or those tending toward plastic behavior). Moreover, while the relationship between extension length of the insert and the cutter penetration rate in soft formations is well known, the use of greater extension lengths have not previously been utilized. This is generally attributed to the likelihood of metal-to-metal interference between the insert and the adjacent cutter with constructions of the prior art; the greater potential for insert wear of breakage and the desire to maintain present center-to-center dimensional placement arrangements for maximization of inserts.

Also vital in soft formation cutting is the need for adequate crest length for earth removal with a scraping action once the cutter has effected penetration. By virtue of the geometric configurations of conventional insert cutter tips, efforts to increase the extension to a maximum have resulted in a crest length that is proportionally reduced with a correlated reduction in insert strength. Consequently, mere extension of prior art constructions to achieve longer overall length with an increase in crest length has required an increased insert diameter in order to maintain even a constant crest length. With a larger diameter the crest length occurs further removed from the base, thus contributing to an increased extension. At the same time the larger diameter has the undesirable effect of reducing the number of inserts placeable about the cutter (cone) surface. If reduced to an insufficient number, the cutters become operationally ineffective or inefficient for removing the formation. Alternatively, if the extension of the insert is increased, it potentially produces the above mentioned interference between adjacent cutters, which in turn, requires either relocating the insert or modifying the material thickness surrounding the insert. The latter is of course vital to the strength and integrity of the cone against fracture and erosion wear and both are usually avoided to ensure adequate insert retention in its socket. Likewise the insert location is important for ensuring proper stress loading of the insert and the rock bit bearings while rendering the bit operationally effective for proper removal of the formation across the hole.

Despite recognition of the foregoing problems, a ready solution therefor has not heretofore been known.

SUMMARY OF THE INVENTION

The invention relates to rock bits and more specifically to a cutter tooth for rock bits shaped with a configuration affording relatively longer wear characteristics and an enhanced rate of penetration through relatively soft earth formations. This can normally be achieved without altering present bit designs for cutter placement of the inserts so as to enable previously established placement parameters therefor to be maintained.

In accordance with the invention the foregoing is effected utilizing a special tooth shape suitable as either a milled tooth or as an insert for rotary earth boring cutters. The tooth or insert (hereinafter sometime called "cutting element") is configured so as to provide a contiguous generally pyramidal shape that in a preferred embodiment has four converging planar surfaces terminating in an outermost, pointed-like end similar to a spade or spear. This configuration takes advantage of a more pointed-like crest as viewed in a frontal elevation. Due to the increased unit loading caused by the reduced area at the point of contact with the formation in combination with an increased crest length created by the pyramidal shaped crest, the width of the kerf cut is effectively increased since the same width is cut as would be cut by a conventional chisel shape cutter while concomitantly effecting a cut of increased depth. This enables the cutting element to penetrate (fracture and/or sink) and remove more volume of soft and/or friable formations such as Clays, Sandstones and Marl more readily than conventional prior art cutting elements. Consequently, lighter drilling weights may be used on a rock bit employing the specific shaped cutter element hereof which further reduces the possibility of cutter element breakage.

Geometrically, the working segment of the cutting element has two distinct portions. The lower portion of the element immediately beyond the base is preferably a truncated six sided pyramidal shape, although the insert form will preferably have all corners generously rounded to reduce stress. Further, the base of the lower portion must be cylindrical to sit atop the cylindrical base of the cutter to which it is to be secured pressed into a socket thereof.

The upper portion represents a modified four sided pyramid having its base elongated from opposite corners, and a ridge formed by the intersection of opposed flank faces define two acute angles (in a horizontal cross section), effecting a single elongated crest that runs through the apex of the pyramid. The ridge (or crest) is of uniform width and in the insert form is rounded to reduce stress. Utilizing this ridge increases the lenth of crest about 13% to about 30% over a conventional chisel shaped insert having essentially the same basic geometric parameters of width/diameter and extension, with the latter being understood as relating to the length of the working end of the cutter element. The intersection of merging faces separately on each of the flanks produce obtuse angles (forming the flanks of the cutter) that are gently rounded or smoothed in the insert form to further reduce possible stress. The four faces of the upper pyramid are commonly extended down into the lower pyramid to form four of the six sides and complete the flanks of the cutter element. By this means the insert is comprised of two back-to-back flanks comprising two facets each.

The resulting leading and trailing flanks ultimately have two surfaces each that intersect or merge at a line corresponding to the longitudinal axis of the insert and slant or slope from that line away from each other to form a somewhat uniform crest width. Because of this configuration, the leading flank is a relatively large blade allowing the cutter element to create a plowing effect which as earth is removed or loosened can escape across the slanted faces and around the cutter to minimize the possibility of breakage. This feature in combination with the pointed-like crest tends to locate encountered loading towards the center helping thereby to offset any rotational tendencies of the insert type in its socket.

By virtue of being able to more easily penetrate into the formation while the increased crest length functions to afford increased scraping, the penetration rate is significantly increased as compared to what has been previously available. The rate can be further enhanced by controllably extending the effective tooth length in the manner hereof to the maximum possible while still avoiding an interfering engagement against the adjacent cutter of a multiple rotary cutter rock bit. The shape in accordance herewith is suitable for use as the cutting element on either a mill tooth bit or a tungsten carbide insert bit. The latter, by virtue of its long wear properties, affords longer work characteristics such that use on rotary cutters having a large amount of bit offset will be more efficient to operate in soft formations by enabling a high rate of penetration to be maintained for an even longer period of time than previously possible.

Not only does the cutting element design hereof afford operational advantages, but when used as an insert permits the prior center-to-center insert placement spacings to be utilized for maintaining structural integrity of the conical body on which the inserts are mounted. By the metal content between the cone shell and the bearing cavity being maintained as before for structural integrity in combination with sufficient metal quantity being maintained surrounding each cutter insert, a hoop stress from press fitting the insert does not produce cracking while the inserts are readily retained during use against loss from their sockets.

It is, therefore, an object of the invention to effect a novel design configuration for the cutting element of a rock bit affording enhanced rates of penetration in relatively soft geological formations.

It is a further object of the invention to effect the previous object with an economical construction having negligible, if any, increased cost of fabrication associated therewith, as compared to the cost of similar purpose cutting elements utilized in the prior art.

It is a further object of the invention to provide a novel rock bit construction utilizing the cutter element formation of the preceding objects.

DESCRIPTION OF THE PREFERRED EMBODIMENT

Figure 1:
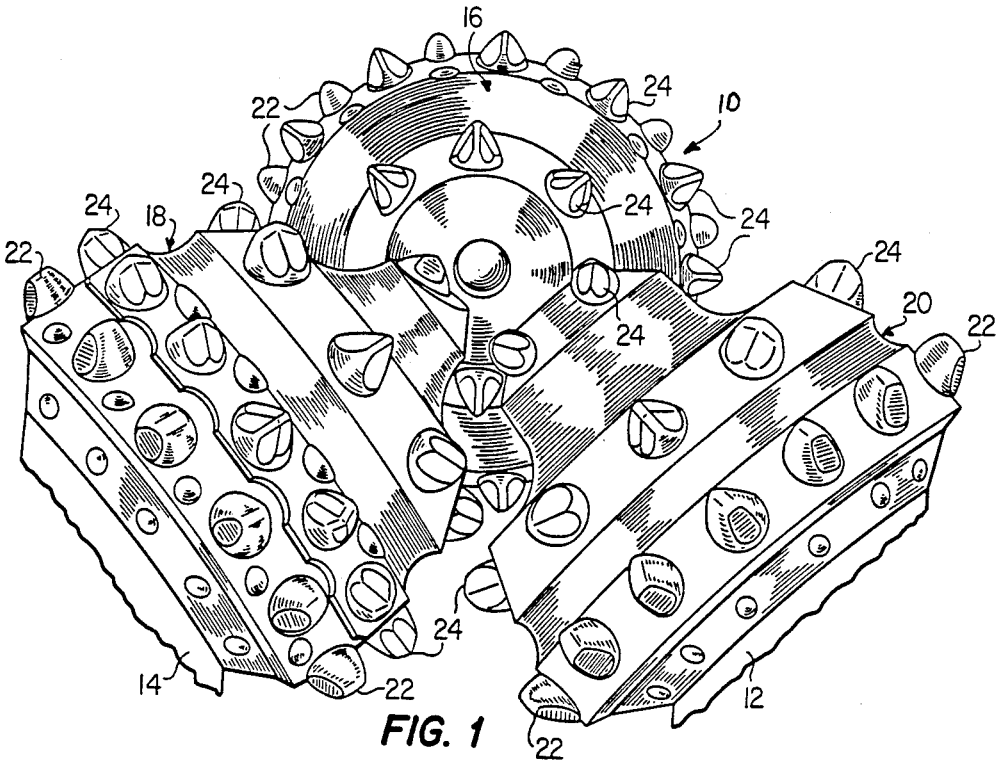
FIG. 1 is a cutaway perspective illustration of a three cone rolling cutter rock bit embodying the present invention.
Figure 2:
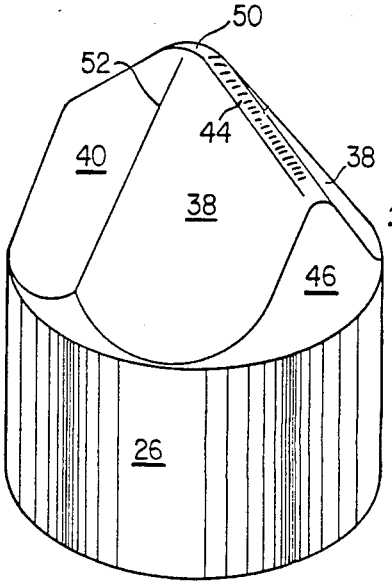
FIG. 2 is an isometric view of an insert cutter element in accordance with the the invention.
Figure 3:
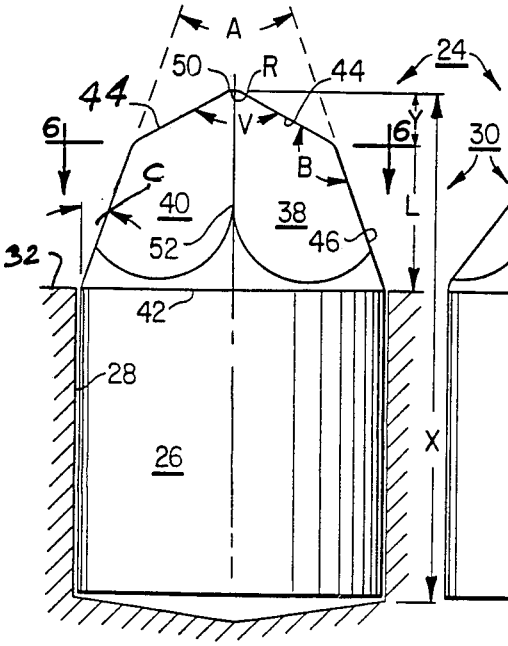
FIG. 3 is a front elevation of the tooth embodiment of FIG. 2.
Figure 4:
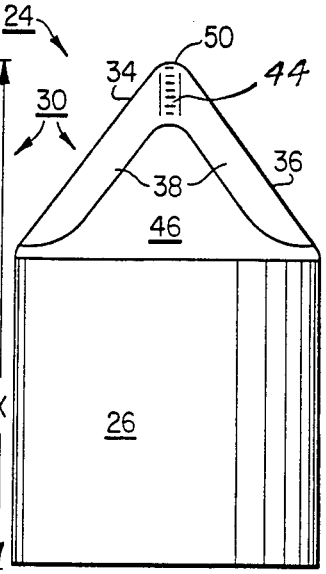
FIG. 4 is a side elevation of FIG. 3.
Figure 5:
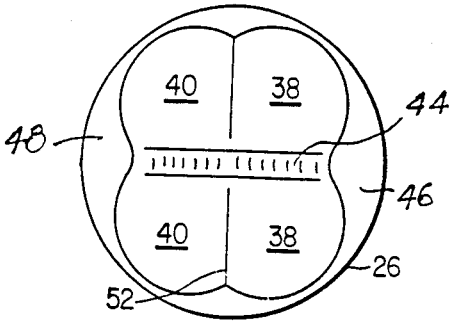
FIG. 5 is a plan view of FIG. 3.

Referring now to the drawings and to FIG. 1 in particular, a rotary rock bit embodying the present invention is illustrated and is generally designated by the reference character 10. The bit includes a body to be connected at its pin end to the lower end of a drill string (not shown) and a passage (not shown) providing communication for drilling muds or the like passing downwardly through the drill string. In this manner drilling mud is directed to the bottom of the well bore and passed upwardly in the annulus between the wall of the well bore and the drill pipe carrying cuttings and drilling debris therewith.

Depending from the body of the bit are three substantially identical arms with arms 12 and 14 being illustrated. The lower end portion of each of the arms is provided with a conventional bearing pin and each arm in turn rotatably supports a generally conical cutter member designated 16, 18 and 20. The bearing pins carrying the cutting members define axes of rotation respectively about which the cutter members rotate on axes tilted downwardly and inwardly at a predetermined angle.

Each of the cutter members 16, 18 and 20 includes a nose portion that is oriented toward the bit axis of rotation and a base that is positioned at the intersection between the wall of the well bore and the bottom thereof. Each of the cutter members likewise includes an annular row of inserts 22 which may be constructed in accordance with the invention as will be described and located adjacent the base of each cutting member. The row of inserts 22 cut the intersection between the well bore wall and the bottom thereof. Each of the cutter members 16, 18 and 20 likewise include at least one annular inner row of inserts 24 which may be similar to insert 22 for destroying the inner portion of the hole as is known in the art. Such inserts are typically force fit into bored openings in the cutter shell and retained by an interference fit. For integrity of the cutter it is essential to maintain sufficient shell material surrounding each insert to withstand encountered stresses. At the same time, most efficient operation dictates that the number of insert rows be maximized. In the preferred embodiment, only the inner row of inserts 24 are constructed in accordance herewith as will be described, while the remaining inserts 22 can be of another configuration determined suitable for the intended purpose.

Referring now of FIGS. 2–6, there is illustrated cutter inserts 24 in accordance herewith. Each insert is generally double pyramidal and has a special configuration as illustrated, that includes a cylindrical base 26 adapted to be inserted force fit into a cutter retaining bore 28 with its longitudinal axis normal to the surface of the cutter (cone). A cutting tip 30 extends integrally from the cylindrical base and protrudes outwardly beyond the cutter surface 32. Comprising the cutting tip 30 for purposes of this embodiment are two symmetrical back-to-back flanks including a leading flank 34 and an identical trailing flank 36. Each flank includes two planar surfaces 38 and 40 ascending longitudinally at the joinder plane 42 of the cutting tip 30 with the top of base 26 and which converge respectively to a crest 44 while merging toward each other.

The appearance of the two flanks reveals each to be comprised of the two relatively sloping plane faces 38 and 40 for a total of four faces or facets on each insert. Adjacent and connecting each flank on the lower portion of the cutting tip 30 for a length L are intersecting faces 46 and 48 that have been rounded to minimize stress. Connecting each flank on the upper portion of the cutting tip for a length Y is a rounded ridge or "crest" 44, forming an upper pyramidal vertex angle "V" at its distal end defining an apex 50. The apex is rounded with radius R. The lower pyramidal surfaces 38, 40, 46 and 48 extend from the junction 42 of the cutting tip 30 with the top of the base 26 and continue to the intersection defined by angle B for a total axial distance L at a contained angle A. Extending upward from the intersection of angle B, the continuation of surfaces 38 and 40 define the upper pyramidal portion for an axial distance Y. From the apex 50 to the underside of base 26 insert 24 is comprised of a total length represented by dimension X. As shown, the lower surfaces 46 and 48 are inclined inwardly at an angle C of approximately 20° from the vertical and typically can range from between 15° to about 25°. The flanks 34 and 36 are symmetrical with respect to each other such that a mediam plane passing through their longitudinal axis divides the crest in half along its length defining two symmetrical halves thereof. A section cut transversely through the shaped (cutting) portion of the insert (see FIG. 6) reveals the cross section to be substantially of an elongated diamond-like shape having rounded corners intersecting with the side faces.

The angle B formed at the intersection of surfaces 44 and 46 can be as large as 150° adding to the strength of the corners formed thereat while vertex angle V of the upper pyramid can be as small as 90° depending on how pointed a tip is desired. The preferred form of the embodiment includes an angle B of about 135° formed by the intersection of the truncated lower and the upper pyramids. About a 120° vertex angle V and a radius R of 0.094 inches or larger on the upper pyramid is generally preferred because of the superior strength which it affords as compared to smaller angles.

Figure 6:
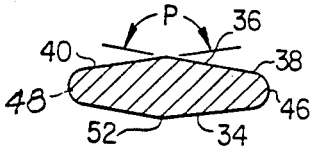
FIG. 6 is a sectional plan view as seen substantially from the position 6—6 of FIG. 3.
Figure 7:
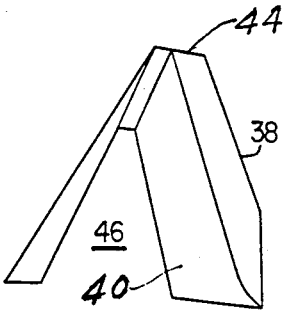
FIG. 7 is a partial isometric view of a milled cutting element in accordance with the invention.
Figure 8:
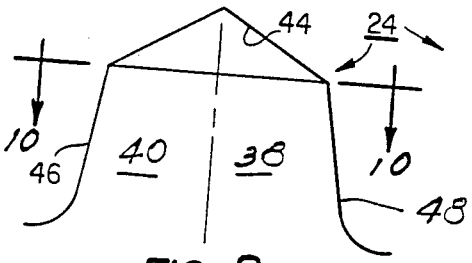
FIG. 8 is a front elevation of the tooth embodiment of FIG. 7.
Figure 9:
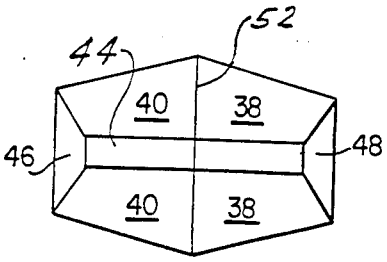
FIG. 9 is a plan view of FIG. 8.
Figure 10:
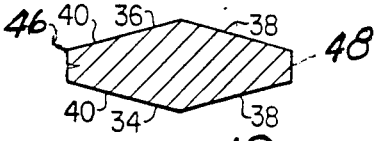
FIG. 10 is a sectional plan view as seen substantially from the position 10—10 of FIG. 8.
Figure 11:
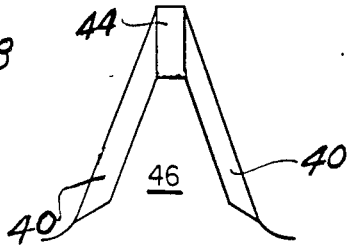
FIG. 11 is a side elevation of FIG. 8.

Contained within each of the opposite flanks 34 and 36 are the merging juxtaposed planar surfaces 38 and 40 separated by an intervening center line or ridge 52. Each of the planar surfaces (or faces) 38 and 40 are angularly inclined relative to each other at an angle P (FIG. 6). For added strength, the angle P between the planar surfaces 38, 40 is reasonably large and is contingent on how uniform a crest width is desired. In a preferred embodiment, angle P is approximately 130°–150°, preferably about 140° with the larger the angle the less uniform the crest.

It will be appreciated that in the structural configuration just described, the inserts 24 include four planar surfaces 38 and 40 symmetrically sliced through to form a pointed shape tip 30 similar to a spade or spear. Increasing the crest length with a relatively pointed tip is effective in combination to penetrate and scrape the soft earth formations more efficiently.

The truncated vertex angle A is about 30°–50°, preferably about 40° since larger angles will more rapidly reduce crest length at the desired extension and much smaller angles are undesirable due to tooling limitations. The vertex angle V of crest apex 50 can be as small as 90° depending on how pointed a tip is desired. A preferred form of the invention includes about a 120° vertex angle V for a shank 26 of diameter between $\frac{1}{8}$ inches and $1\frac{1}{2}$ inches because of the superior strength it affords versus the smaller angles. A generous radius R of about 1/16 inches to $\frac{1}{2}$ inch is likewise preferred. This vertex angle along with the total insert tip extension L+Y (FIG. 3) largely controls the total length of crest 44. Utilizing a vertex angle V with a range of about 90° to 120°, the crest length will be increased approximately 13% to 30% over a conventional chisel shaped insert having the same basic geometric parameters (diameter, extension and truncated cone angle). By comparison, utilizing a relatively pointed crest tip constructed in the manner hereof, produces an increased crest length as explained while resulting in an increased insert extension length of dimension Y represented by the two equi-angular sides forming the vertex angle V. As can be appreciated, the angle B formed at the juncture of surfaces 46 and 48 affects the ultimate extension dimension whereby interference mentioned supra can still be avoided.

In the embodiments of FIGS. 7–11 there is illustrated a milled tooth version of the cutting element in contrast with the insert type described supra. This results in a more defined form of the pyramidal shapes involved, with cross sections revealing straight edges and non-rounded corners. For the obvious reasons, the milled tooth version lacks a cylindrical base 26 as described in the previous embodiment since it is formed as an integral part of the roller cone. Further, the milled tooth version does not require corners or intersecting surfaces to be rounded due to the inherent strength of the roller cone steel. With the exception of base 26, the remainder of the nomenclature for this embodiment corresponds with that utilized in FIGS. 2–6.

From the above description it should be apparent that a cutting element has been provided having significant advantages over prior art constructions for cutting soft earth formations. The wedge like cutting tip in the frontal elevation engages the formation with a point that increases the unit loading on the formation and which serves to increase the ease by which the soft formations can be penetrated. In combination with the increased crest length, it more easily removes the earth by penetrating and scraping or gouging. This effect will be at its optimum when used with rock bits incorporating offsets that are normally utilized for soft earth formations. Moreover, its construction promotes wear of the insert at the center versus the outer or inner corners as seen on conventional tooth-shaped inserts, such that any wear at the outer or inner corners will tend to increase the crest point, thereby enhancing its penetration capability. Utilizing the construction hereof also results in the ability to increase the crest length without reducing the extension of a given insert.

By virtue of being able to more easily penetrate into soft formations, such as clays, sandstones and other friable formations, the penetration rate for boring through the formation is significantly enhanced. Even greater enhancement is achieved by the ability to controllably extend the effective tooth length in the manner hereof to the maximum possible, without incurring an interfering engagement with the adjacent cutters with which it cooperates. In addition, it permits the prior center-to-center insert placement dimension to be maintained for structural integrity of the conical body on which the inserts are mounted. Incident thereto, metal content between the cone shell and the bearing cavity is maintained as before for structural integrity while sufficient metal surrounding each cutter insert is likewise maintained as before so that when the inserts are press fit into the body sockets, a hoop stress is not imposed from which cracking could otherwise occur. Likewise the insert is retained as before against inadvertent drop-out from its socket.

Since many changes could be made in the above construction, and many apparently widely different embodiments of this invention could be made without departing from the scope thereof, it is intended that all matter contained in the drawings and sepcification, shall be interpreted as illustrative and not in a limiting sense.

I claim:

1. A shaped cutting element for an earth boring rock bit comprising:

(a) means defining a base;

(b) a cutting tip having back-to-back double faced flanks joined extending outward from said base to a distal end defining a single wedgelike crest of predetermined apex angle and substantially uniform width; said cutting tip including:

(1) first and second contiguously intersecting substantially pyramidal portions successively extending longitudinally continuous from said base to said apex;

(2) said first pyramidal portion being joined to said base and having a greater number of faces than the number of faces on said second pyramidal portion extending to said crest; and (3) said pyramidal portions being defined in a cross sectional plane taken therethrough substantially transverse to the longitudinal axis of said cutting tip as having said flanks arranged symmetrically with each flank being formed by a pair of merged planar faces angled obtusely relative to each other.

2. A cutting element in accordance with claim 1 in which said back-to-back joinder of said flanks is defined in said section as forming an acute angle.

3. A cutting element in accordance with claim 2 in which the sectional widths of said merged faces is substantially equal.

4. A cutting element in accordance with claim 1 in which the merged faces of said second pyramidal portion are common with faces on said first pyramidal portion as comprising continuous extensions of each other.

5. A cutting element in accordance with claim 4 in which said common faces on said first pyramidal portion are dimensionally larger than the remaining faces thereon.

6. A cutting element in accordance with claim 2 in which said flank joinder defines a rib of substantially uniform width intervening between the faces of said joined flanks and extending about said apex.

7. A cutting element in accordance with claim 1 in which the obtuse angle between said merged faces is in the range of between about 130–150 degrees.

8. A cutting element in accordance with claim 7 in which said apex angle is in the range of between about 90–120 degrees.

9. A cutting element in accordance with claim 8 in which said first pyramidal portion is defined in the general plane of its flanks by an included angle in the range of between about 30–50 degrees.

10. A cutting element in accordance with claims 1, 2, 3, 6 or 7 in which said cutting element comprises an insert and said base is cylindrical and is adapted for a force fit mounting in an insert socket of a rock bit.

11. A cutting element in accordance with claims 1, 2, 3, 6 or 7 in which said cutting element comprises a mill tooth extending from an integral surface protrusion on a rock bit.

12. In a rotary bit having at least one rolling cutter member for forming a bore hole in the earth, said rolling cutter member having at least one annular row of cutter inserts mounted in sockets in the cutter member for cutting the inner portions of the bore hole, the improvement in which said inserts comprise:

(a) means defining a base;

(b) a cutting tip having a double faced leading flank and a joined double faced trailing flank extending outward from said base defining means to a distal end defining a single wedge-like crest of predetermined apex angle and substantially uniform width; said cutting tip including:

(1) first and second contiguously intersecting substantially pyramidal portions successively extending longitudinally continuous from said base to said apex;

(2) said first pyramidal portion being joined to said base and having a greater number of faces than the number of faces on said second pyramidal portion extending to said crest; and (3) said pyramidal portions being defined in a cross sectional plane taken therethrough substantially transverse to the longitudinal axis of said cutting tip as having said flanks arranged symmetrically with each flank being formed by a pair of merged planar faces angled obtusely relative to each other.

* * * * *